United States Patent [19]

Åslund

[11] Patent Number: 4,486,385

[45] Date of Patent: Dec. 4, 1984

[54] TUBULAR COMPOSITE ELEMENTS PROCESSES AND A PRESSING FOR THEIR PRODUCTION

[75] Inventor: Christer Åslund, Torshälla, Sweden

[73] Assignee: NYBY Uddeholm AB, Torshalla, Sweden

[21] Appl. No.: 243,771

[22] Filed: Mar. 16, 1981

[30] Foreign Application Priority Data

Mar. 14, 1980 [DE] Fed. Rep. of Germany ..... 3009916

[51] Int. Cl.[3] ..... B22F 5/00; B22F 3/00

[52] U.S. Cl. ..... 419/48; 419/6; 419/41; 419/42; 428/554; 428/558

[58] Field of Search ..... 75/208, 226, 214; 428/547, 548, 549, 554, 557, 558; 29/420.5, 420; 419/48, 41, 42, 3, 5, 6

[56] References Cited

U.S. PATENT DOCUMENTS

| | | | |
|---|---|---|---|
| 2,947,080 | 8/1960 | Kates et al. | 75/208 R |
| 3,034,178 | 5/1962 | Cartier et al. | 75/214 |
| 3,109,797 | 11/1963 | Maxwell | 75/208 CS |
| 3,305,923 | 2/1967 | Zimmer | 75/208 R |
| 3,335,001 | 8/1967 | Drew et al. | 419/6 |
| 3,723,109 | 3/1973 | Cairns | 75/214 |
| 3,824,097 | 7/1974 | Smythe et al. | 75/214 |
| 4,101,712 | 7/1978 | Bomford et al. | 428/547 |
| 4,131,461 | 12/1978 | DePierre et al. | 75/208 CS |
| 4,143,208 | 3/1979 | Aslund | 75/208 R |
| 4,401,723 | 8/1983 | Aslund et al. | 428/554 |

FOREIGN PATENT DOCUMENTS

| | | | |
|---|---|---|---|
| 0213073 | 6/1960 | Austria | 75/208 CS |
| 0663941 | 5/1963 | Canada | 75/214 |
| 0714653 | 9/1954 | United Kingdom | 72/258 |
| 1185683 | 3/1970 | United Kingdom | 72/258 |

*Primary Examiner*—Benjamin R. Padgett
*Assistant Examiner*—Anne Brookes
*Attorney, Agent, or Firm*—Antonelli, Terry & Wands

[57] ABSTRACT

A tubular composite element of metal, particularly steel, whereby at least the two opposite ends of the tubular composite element consist of different materials, for example carbon steel and stainless steel, and a process and a pressing for simultaneously producing two or more of such composite elements, at least two powders each consisting of one of the different materials, which have been produced by atomizing melts of the materials in question, are introduced alternately and separately from one another into three or more sections each extending over a predetermined axial length of a metallic hollow cylindrical casing and are condensed by vibration and/or ultrasound to around 60 to 70% of the theoretical density and by cold isostatic pressing of the closed casing under a pressure of at least about 3000 bars to at least 80% of the theoretical density and the pressing thus obtained is heated, subsequently hot-extruded to form a tube and the tube thus formed is divided up into the two or more composite elements mentioned above.

55 Claims, 6 Drawing Figures

TUBULAR COMPOSITE ELEMENTS PROCESSES AND A PRESSING FOR THEIR PRODUCTION

Figure 1:
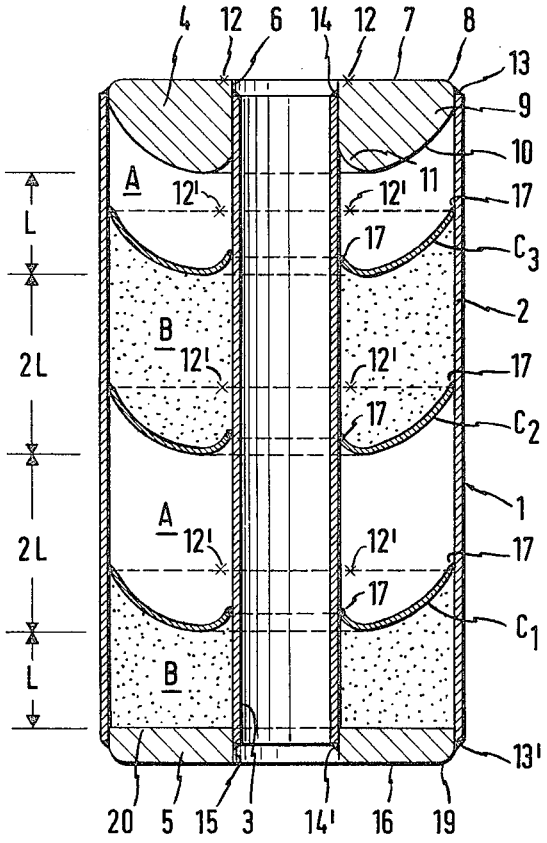

This invention relates to tubular composite elements consisting of at least two sections of different materials joined to one another, and to processes and pressings for producing these composite elements.

When components of different steels are welded together, the properties of the steels, particularly their strength, corrosion resistance, surface quality and the like are known to be adversely affected in the region of the weld seam, so that efforts are generally made to avoid welding different types of steel. In practice, however, it is frequently not possible, particularly in plant and apparatus construction, to produce all the components involved from steel of the same quality. In many cases, it is necessary to install valves, pumps or similar components which are made of a different material from the pipes in which they are installed.

The object of the present invention is to provide an inexpensive process for producing high-quality tubular composite elements of metal, particularly steel, in which the two opposite ends of the tubes consist of different materials, for example carbon steel and stainless steel, these composite elements making it unnecesarry to weld different materials in the assembly of pipe and apparatus components of different quality.

According to the invention, this object is achieved—in further development of the process according to the prior co-pending application, Ser. No. 088,479, filed Oct. 26, 1979 now U.S. Pat. No. 4,401,723—in that two or more composite elements are simultaneously produced, at least two powders each consisting of one of the different materials, which have been produced by atomising melts of the materials in question and which consist predominantly of spherical particles, are introduced alternately and separately from one another into three or more sections each extending over a predetermined axial length of a metallic hollow cylindrical casing and are condensed by vibration and/or ultrasound to around 60 to 70% of the theoretical density and by cold isostatic pressing of the closed casing under a pressure of at least about 3000 bars to at least 80% of the theoretical density and the pressing thus obtained is heated, subsequently hot-extruded to form a tube and the tube thus formed is divided up into the two or more composite elements mentioned above.

The casing is preferably closed at its front end by means of a plug made of a ductile material, preferably a ductile metal, such as, for example, soft iron, low-carbon steel or cast iron, of which the yield point in the container of the extrusion press is considerably below the yield point of the powder filling of the pressing so that the extrusion process begins at the pressure required for the ductile material of the plug and encroaches by tunnel effect onto the powder filling. This front plug is preferably generally conical in shape, its conical outer jacket having a substantially arcuate cross-sectional profile of which the centre points lie on a circle which is concentric with the flat end face of the plug, but which surrounds the inner jacket of the tube with a gap in between in such a way that, when the pressing formed from the casing is introduced into the container of the extrusion press which has a flat front end face, this circle on which the centre points of its cross-sectional profile are situated lies substantially in the middle of the annular gap of the extrusion tool.

The effect of shaping and arranging the substantially arcuate cross-sectional profile of the front plug in this way is that, on extrusion of the pressing, the front plug consisting of soft iron or a similar metal forms with the weld seams and the adjacent parts of the outer jacket and inner jacket of the casing a first part of the extruded tube which accumulates as waste and which is separated by a clear separation surface extending substantially perpendicularly of the longitudinal axis of the tube from the following part which forms the actual tube and which consists at least partly of high-quality material. By virtue of this clear separation surface, the first part which accumulates as waste may readily be cut off after extrusion or even drops off on its own providing the connection to the following part which forms the actual tube and which consists at least partly of high-quality material, particularly stainless steel, has little or no strength.

According to the invention, it is of advantage to provide the boundaries between the sections of the casing consisting of powders of different materials with a conical or funnel-like shape preferably characterised by a substantially arcuate cross-sectional profile, the centre points of this arcuate cross-sectional profile forming a circle which extends substantially concentrically around the inner jacket of the casing, preferably with a gap in between which corresponds to substantially half the width of the annular gap of the extrusion tool. The effect of shaping the boundaries between the sections consisting of different powders in this way is that, in the extruded tube, these boundaries extend substantially perpendicularly of the longitudinal axis of the tube.

According to the invention, metallic intermediate layers may be inserted at the boundaries between the sections of the casing consisting of powders of different materials. These metallic intermediate layers preferably consist of a material, such as nickel for example, which prevents or inhibits the diffusion of impurities and/or alloying elements, particularly carbon, thereby preventing any change or deterioration in the properties of the two different materials through the diffusion of impurities or alloying elements from one material into the other.

Similarly to the boundaries between the sections each consisting of one of the two powders, it is possible in accordance with the invention to provide the metallic intermediate layers with a conical or funnel-like form which preferably has a substantially arcuate cross-sectional profile, the middle points of this arcuate cross-sectional profile forming a circle which preferably lies substantially in the plane passing through the outer edge of the metallic intermediate layer and which extends concentrically around the casing, preferably with a gap in between which corresponds to substantially half the width of the annular gap of the extrusion tool. More particularly, the metallic intermediate layer may be in the form of an annular dish of substantially arcuate cross-section which is preferably produced by deep-drawing and which, when the casing is being filled, can be pressed into the powder filling by means of a tool until the powder filling is firmly applied substantially everywhere to the convex lower outer jacket of the metallic intermediate layer. To make the metallic intermediate layer easier to press in, it can be of advantage to turn the casing and/or the intermediate layer about the longitudinal axis of the casing to obtain a relative rotational movement between the intermediate layer and the powder filling when the intermediate layer is being pressed into the powder filling. The metallic intermediate layers mentioned above may be fixed to the outer and/or inner jacket of the casing, preferably by spot welding.

Single-layer or multilayer, preferably narrow-mesh wire nets and/or ring-shaped or funnel-shaped inserts consisting of layers of metal filaments preferably compressed in the manner of a fleece may also be used as the metallic intermediate layers.

It can also be of advantage to introduce at least one intermediate layer at the boundaries between the sections consisting of one of the two powders by introducing mixtures of the two powders made of different materials. In this connection, it can be of advantage, when introducing the intermediate layers, continuously to alter the mixing ratio between the two powders in such a way that the proportion of the first powder of which the previously filled section exclusively consists gradually decreases over the thckness of the intermediate layer from 100% to 0% whilst the proportion of the second powder increases from 0% to 100% so that a smooth, continuous transition is obtained in the composition of the material between the previously filled section consisting of the first powder and the section consisting of the second powder to be filled after the intermediate layer.

To make it easier to divide the extruded tube into the individual composite elements, it can be of advantage in accordance with the invention—in the case of the sections produced from only one of the two powders which are separated after extrusion to obtain the individual composite elements—to introduce in the vicinity of these separation points intermediate layers of glass or any other material capable of preventing a metallic bond in order to form predetermined breakage points, these intermediate layers used to form predetermined breakage points preferably being provided in accordance with the invention with a funnel-like or conical form of arcuate cross-section so that, after the tube has been extruded, the predetermined breakage points extend substantially perpendicularly of its longitudinal axis. At the same time, a plug arranged at the front end of the casing is preferably also provided on that surface directed towards the powder filling with a layer or coating of glass or any other material capable of preventing a metallic bond in order to obtain at this point, too, a predetermined breakage point which extends substantially perpendicularly of the longitudinal axis of the extruded tube.

According to the invention, it can also be of advantage to provide the surface of the powder filling—at least at the boundary between two different powders and before and/or after introduction of an intermediate layer—with a parabola-like cross-sectional profile by rotating the casing about its longitudinal axis, with the result that, after extrusion of the tube, the above-mentioned boundary or the intermediate layer extends substantially perpendicularly of its longitudinal axis.

It is preferred to use a casing in which at least the outer jacket but preferably the outer and inner jackets are provided with outwardly directed bulges which are designed to take up the shrinkage which occurs during isostatic pressing and which are gauged in such a way that they are substantially eliminated again by the contraction which takes place during the isostatic pressing process, and which bulges are preferably produced according to U.S. application Ser. No. 088,479. This shape of the casing results in that, after cold isostatic pressing of the casing, the pressing does not look like an "hourglass" with a constricted centre. This so-called "hourglass" shape frequently arises out of the fact that the ends of the casing which are closed by covers or the like do not shrink to the same extent as the middle part of the casing during cold isostatic pressing. Since the extrusion process requires a pressing of which the outer jacket is as near as cylindrical as possible, it is necessary, where the pressing resembles an "hourglass" to trim the ends which is not only a very expensive operation, it also involves the danger of cracks developing. The bulging of the casing in accordance with the invention affords the advantage that there is no need for the pressing to be machined or trimmed to make it cylindrical in shape because the outwardly directed bulges of the casing make it possible to produce pressings of which the diameters correspond very exactly to the required diameters of the pressing. It is possible to achieve accuracies of ±0.2% and, more particularly, ±0.1% and to make the diameters of the pressing accurate to within ±0.2 mm and, more particularly, ±0.1 mm.

In combination with a casing described in the preceding section, it is of advantage to use a front plug for the casing which has a flat end face which, along its outer circumference, changes into a bevelled edge. Effective lubrication is obtained during extrusion as a result of the fact that the glass used for lubrication, which is arranged in the form of a glass disc at the end of the pressing in a container or receptacle of the extrusion press with a flat front end surface, is delivered in the peripheral direction in substantially uniform distribution between the tool and the extruded object throughout the entire extrusion process by the bevelled front edge of the front plug of the casing in conjunction with the very accurate adaptation of the substantially cylindrical external diameter of the pressing to the substantially cylindrical internal diameter of the container or receptacle of the extrusion press.

Examples of embodiment of the invention are described in detail in the following with reference to the accompanying drawings, wherein:

FIG. 1 is a longitudinal section through one embodiment of the filled and plugged casing designed in accordance with the invention.

FIGS. 2, 3, 3*a*, 4 and 5 are longitudinal sections—similar to FIG. 1—through modified embodiments.

The casing is generally denoted by the reference 1 in FIG. 1 and comprises an outer jacket 2 and an inner jacket 3. The outer jacket 2 preferably consists of a tube section of a spirally welded tube, the helix angle $\alpha$ of the spiral weld seam (not shown) being gauged in such a way that the spiral forms one or more complete turns over the length of the outer jacket 2. The inner jacket 3 is generally formed by a longitudinally welded tube.

In the embodiment illustrated in FIG. 1, a plug 4 forms the cover and a plug 5 the bottom of the casing. Preferably both plugs, but at least that plug 4 which is provided at the front end, are made of a ductile material, preferably a ductile metal, such as for example soft iron, low-carbon steel or cast iron, of which the yield point in the container of the extrusion press is considerably below the yield point of the powder filling of the pressing so that the extrusion process begins at the necessary pressure for the ductile material of the plug and encroaches by tunnel effect onto the powder filling.

The front plug 4 is generally conical in shape and has a central bore 6 for receiving the inner jacket 3 of the casing 1. The conical or funnel-shaped plug 4 has a substantially flat end face 7. However, it is bevelled or rounded off at its outer edge at 8 and, thereafter, has first a cylindrical section 9 which changes into the conical outer surface with its substantially arcuate cross-sectional profile 10, the transition from the latter to the wall of the central bore 6 being rounded off at 11.

The centre point of the substantially arcuate cross-sectional profile 10 lie on a circle which extends concentrically around the bore 6 on the flat end surface 7 and which is indicated by two crosses 12 in FIG. 1. The conical outer surface of the plug is preferably formed in such a way that the circle indicated by the crosses 12, on which the centre points of its cross-sectional profile 10 are situated, lies substantially in the middle of the annular gap of the extrusion tool when the pressing formed from the casing 1 is introduced into the container of the extrusion press which has a flat front end face.

The effect of shaping and arranging the substantially arcuate cross-sectional profile 10 of the plug 4 in this way is that, on extrusion of the pressing, the front plug 4 consisting of soft iron or a similar metal forms together with the weld seams 13, 14 and the adjacent parts of the outer jacket 2 and the inner jacket 3 a first part of the extruded tube which accumulates as waste and which is separated by a clear separation surface extending substantially perpendicularly of the longitudinal axis of the tube from the following part which forms the actual tube and which is made at least partly of high quality material. By virtue of this clear separation surface, the first part which accumulates as waste may readily be cut off after extrusion or even drops off on its own providing the connection to the following actual tube, which consists at least partly of high-quality material, particularly stainless steel, has little or no strength.

In the region of the cylindrical section 9, the plug 4 is tightly welded to the outer jacket 2 by means of an encircling weld seam 13. The inner jacket 3 of the casing is also tightly welded to the plug 4 by means of an encircling weld seam 14.

The substantially flat, annular plug 5 arranged near the bottom or rear end of the casing 1 has a central bore 15 and an outwardly pointing flat end face 16. This plate-like plug 5 is also bevelled or rounded off at its edge at 19. The plug 5 is tightly welded to the outer and inner jackets 2 and 3 by means of encircling weld seams 13' and 14', respectively.

The end face 30 of the rear plug 5 which adjoins the powder filling is flat.

The invention is explained in the following with reference to one example:

In order to produce a pressing for extruding tubular composite elements which have an external diameter of 50 mm and a wall thickness of 5 mm and which consist in sections of standard steel and stainless steel, a spirally welded, 600 mm long tube having an external diameter of 150 mm and a wall thickness of 1.5 mm was prepared as the outer jacket 2 for the casing 1 while a 590 mm long, longitudinally welded tube having a wall thickness of 1.5 mm and an internal diameter of 40 mm was prepared as the inner jacket 3. In addition, an annular base plate 5 of low-alloyed carbon steel containing approximately 0.004% of carbon and having a thickness of 20 mm was prepared, its external diameter corresponding to the internal diameter of the outer jacket 2 and its internal bore 15 corresponding to the external diameter of the inner jacket 3. The inner jacket 3 was then tightly welded to the base 5 by means of an encircling weld seam 14', after which the outer jacket 2 was tightly welded to the base by means of an encircling weld seam 13'. The upwardly open casing 1 was then placed upright on a plate and vibrated at 80 Hz. Two powder qualities A and B were prepared. Powder A consisted of preferably spherical or for the most part of spherical powder of stainless steel having a mean particle diameter of less about 1 mm which had been produced by atomisation from the required stainless starting material in an inert gas atmosphere, preferably an argon atmosphere. Powder B had been similarly produced from a standard steel material as starting material, for example a carbon steel. First powder B was introduced into the casing vibrated at 80 Hz and condensed to a density of around 68% of the theoretical density. After powder B had been introduced into the casing up to a level L, an annular dish $C_1$ of arcuate cross-section was pressed into the annular space of the casing from above by means of a suitable tool and, by rotating the annular dish $C_1$ about the middle axis of the casing and simultaneously vibrating the powder B in the casing, was pressed into powder B until powder B was firmly applied everywhere to the outer surface of the annular dish $C_1$. The dish $C_1$ was then fixed to the inner and jackets by spot welding or by encircling weld seams 17. Tight welding is not necessary here. However, it is generally desirable that the weld should prevent powder B from emerging between the dish $C_1$ and the outer and inner jacket. Powder A which had been produced from a stainless starting material was then introduced into the casing up to a level of about 2 L, the casing being vibrated at 80 Hz as already mentioned. The annular dish $C_2$ was then introduced in the same way as the dish $C_1$ and fixed by means of welds 17. Thereafter, more powder B was introduced into the casing up to a level of about 2 L and vibrated at 80 Hz and the annular dish $C_3$ was introduced in the same way as the dishes $C_1$ and $C_2$ and fixed by welds 17. Powder of quality A was then introduced with vibration up to a level of approximately L, after which the plug 4 was pressed into the top of the casing while it was rotated about its longitudinal axis and at the same time vibrated at 80 Hz and was then welded tightly to the inner and outer jackets by means of weld seams 6 and 8.

The casing was subjected to cold-isostatic pressing at 4700° C. in water to a density of around 88% of the theoretical density. The annular dishes $C_1$, $C_2$ and $C_3$, which are arranged between the sections each consisting of one of the two powders A and B, have a substantially arcuate cross-sectional profile similar to the cross-sectional profile 10 of the front plug 4, the centre points of this arcuate cross-sectional profile forming a circle which is indicated in FIG. 1 by the cross 12' and which lies substantially in the plane passing through the outer edge of the dishes $C_1$, $C_2$ and $C_3$ and which extends concentrically around the inner jacket 3 at an interval substantially corresponding to half the width of the annular gap of the extrusion tool. The effect of this shape of the dishes $C_1$, $C_2$ and $C_3$ and hence of the boundaries between the sections consisting of different powders is that, in the extruded tube, these boundaries between the sections in question extend substantially perpendicularly of the tube axis.

Figure 2:
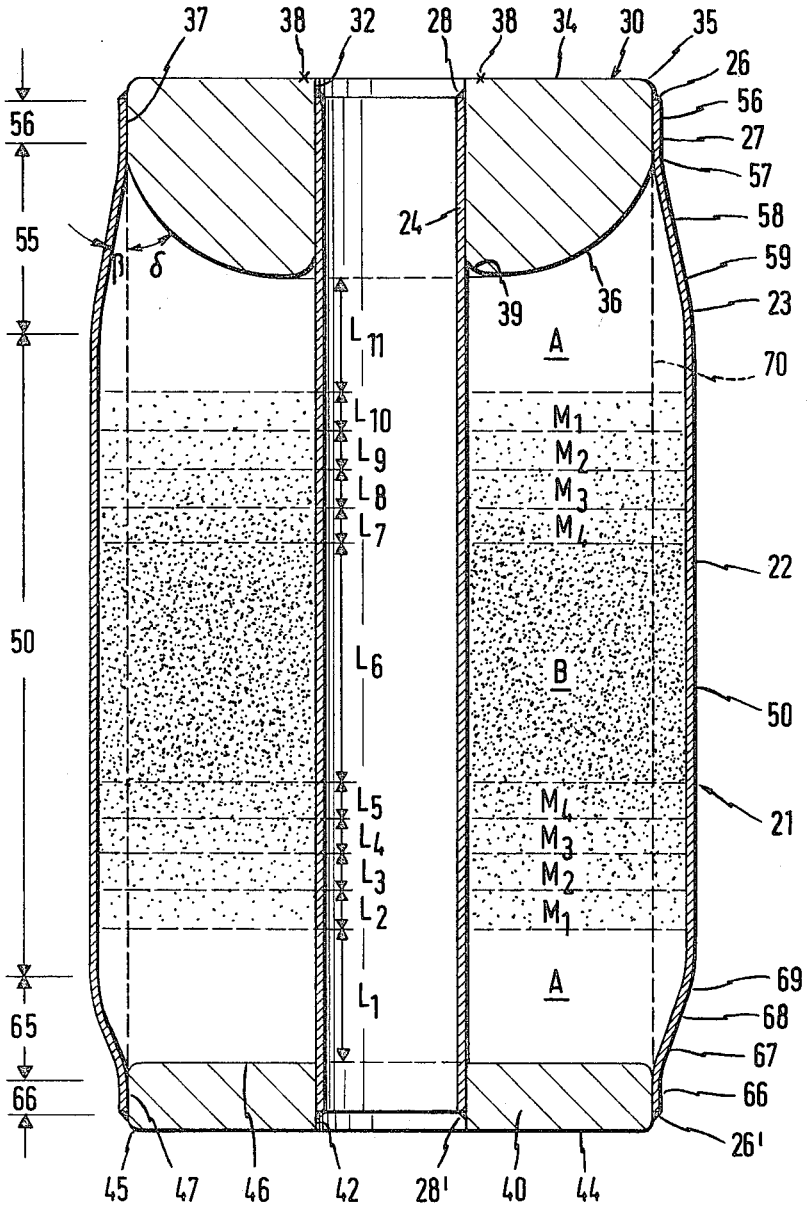

FIG. 2 shows a modified embodiment in which the casing is generally denoted by the reference 21 and comprises an outer jacket 22 with a bulge 23, which will be described in more detail hereinafter, and an inner jacket 24. A plug 30 provided at the front end of the casing 21 has a substantially arcuate cross-sectional profile 36 and a flat end face 34 and a central bore 32. The centre points of the arcuate cross-sectional profile 36 lie on a circle which is situated substantially in the region of the sectional line between the flat end face 34 and the wall of the bore 32, i.e. in the region of the front boundary line of the bore 32, and is indicated by two crosses 38 in FIG. 2. As already mentioned in reference to the embodiment illustrated in FIG. 1, the substantially arcuate cross-sectional profile 36 affords the advantage that, in the extrusion of the pressing, the plug 30 consisting of soft iron or a similar material, the weld seams 26, 28 and the adjacent parts of the outer jacket 22 and the inner jacket 24 form the first part of the tube which, after extrusion, is cut off or even drops off on its own providing the connection to the following tube, which preferably consists of high-quality material and which is made from the powder filling of the casing, has little or no strength. The effect of the substantially arcuate trend of the boundary line 36 of the plug 30 is that the dividing line between the front section of the extruded tube which accumulates as waste and the actual tube preferably consisting of high quality material is clearly defined and assumes the form of a dividing surface which extends substantially perpendicularly of the longitudinal axis of the tube. The plug at the bottom end is also tightly welded to the outer jacket 22 and the inner jacket 24 by means of encircling weld seams 26' and 28'.

To prevent the formation of folds and to obtain a pressing centered as accurately as possible, it is of advantage in accordance with the invention to provide at least the outer jacket 22 in the region between the plugs 30 and 40 with an outwardly directed bulge 23 which is designed to absorb the shrinkage occuring during the isostatic pressing operation and which is gauged in such a way that it is substantially eliminated again during the isostatic pressing operation. Between the plugs 30 and 40, the outer jacket 22 has a substantially constant external diameter in the region denoted by the reference 50. At its front and rear ends, the outer jacket 22 has cylindrical sections 55 and 66 from which the bulge first gradually and steadily increases in the axial direction—towards the middle of the casing—in a region 56; 67 which has a concave cross-sectional profile, the inclination of the outer jacket 22 towards the axis of the casing also increasing gradually and steadily, after which the inclination of the outer jacket remains substantially constant in a conical intermediate zone 58; 68, followed by a region 59; 69 in which the outer jacket 22 has an outwardly convex cross-sectional profile and changes gradually and steadily into the axially parallel middle region 50. The regions 57, 58 and 59 in which the outer jacket 22 varies in its cross-section form a transition zone 55 which is arranged substantially in the region of the plug 30, the cross-sectional outline 36 of the plug 30 being substantially a mirror image of the outline of the transitional region 55 which is reflected at the line 70 corresponding to the shrunk pressing, but is larger in the ratio between the diameter of the pressing to the radial contraction in diameter of the casing. It is important that the outwardly concave region 57, 58 should be an approximate mirror image of the cross-sectional profile 36 of the plug 30, the line 70 representing the mirror symmetry axis and the angle of curvature $\beta$ of the outer jacket 22 being reduced in relation to the angle of curvature $\delta$ of the adjacent plug substantially proportionally to the percentage shrinkage.

The dimensions of the bulge 23 are such that, after the cold isostatic pressing operation, the inner surface of the outer jacket 22 shrinks up to the line 70 which corresponds to the ideal cylinder form. Accordingly, the cylindrical sections 56 and 66 of the outer jacket 22 are also constricted, preferably by rolling, to bring them into alignment with the line 70, the transitional regions 55 and 65 being formed at the same time. It has been found that the bulge of the outer jacket is of advantage for exact centring of the pressing. According to the invention, the bulge of the outer jacket may be used in combination with a spirally welded outer and/or inner tube.

The plug 40, which is arranged at the bottom end of the casing, has a central bore 42 and a flat outer end surface 44, the outer edge of the plug 40 being rounded of or bevelled at 45.

The front plug 30 also has a bevelled or rounded-off outer edge 35 which changes into a cylindrical section 37 and which is adjoined by the already mentioned arcuate cross-sectional profile 36 which is rounded off at 39. The plug 40 at the bottom end also has a cylindrical section 47.

Two powders A and B made of different materials were introduced into the casing 21 in the same way as described with reference to the casing 1 illustrated in FIG. 1. First powder A was introduced up to a level $L_1$ into the vibrated casing 21 tightly closed at its bottom end by means of the insert 40. A powder mixture M1 consisting of a mixture of 80% of powder A and 20% of powder B was then introduced to a level $L_2$. Thereafter a mixture M2 of 60% of powder A and 40% of powder B was introduced to a level $L_3$, followed by a mixture M3 consisting of 40% of powder A and 60% of powder B and introduced to a level $L_4$ and, finally, by a mixture M4 consisting of 20% of powder A and 80% of powder B and introduced to a level $L_5$. Powder B was then introduced to a level $L_6$. The powder mixtures M1 to M4 were then introduced in the reverse order to the levels $L_7$, $L_8$, $L_9$ and $L_{10}$. Powder A was then introduced in such a quantity that, following introduction of the front plug 30, the powder A is firmly applied to the lower outer surface of the plug 30. During introduction of the powders and powder mixtures and of the front plug 30, the casing 21 was vibrated at about 80 Hz. After the front plug 30 had been inserted, it was tightly welded by means of the weld seams 26 and 28.

After it had been plugged, the casing 21 in which the powder introduced had been condensed by vibration to between 60 and 68% of the theoretical density, was subjected to cold isostatic pressing so that the powder filling was condensed to more than 80% and preferably to around 88% of the theoretical density. The pressing thus obtained was then hot extruded to form the tube which was divided into two composite elements.

Figure 3:
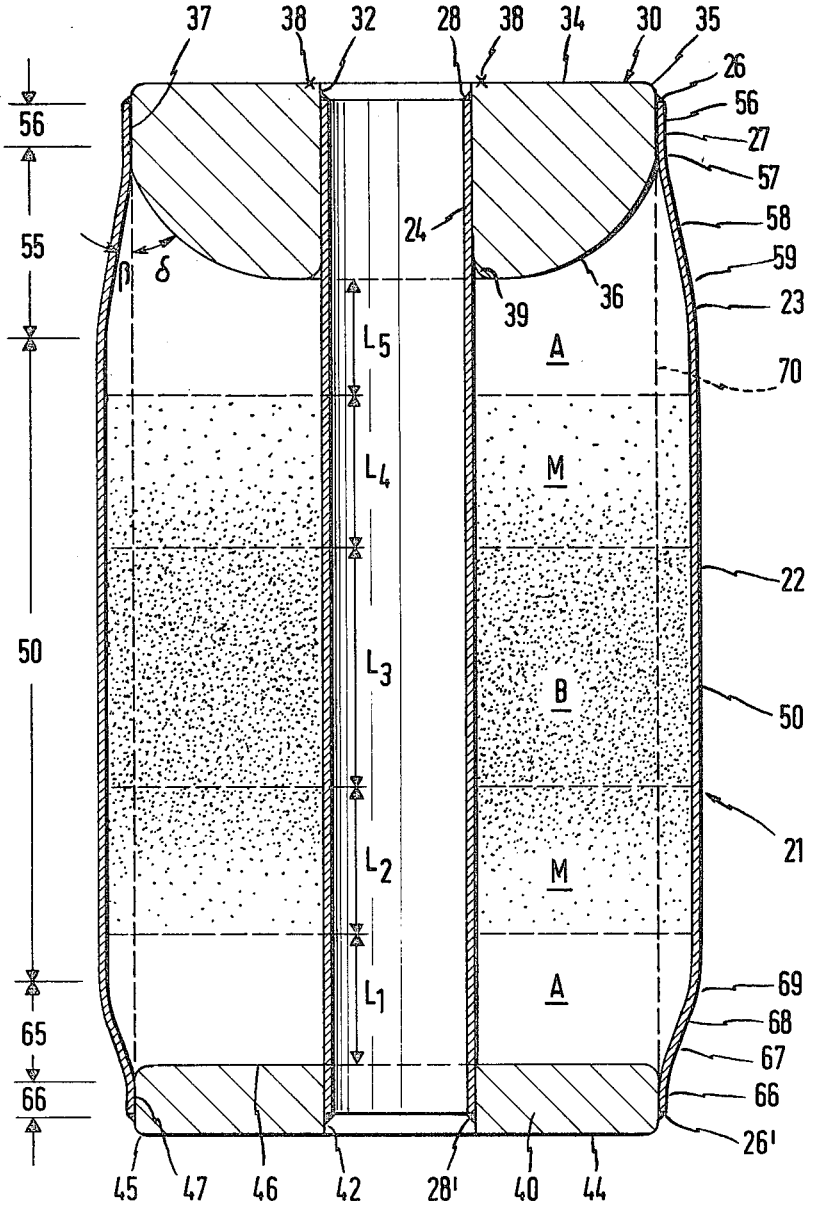

FIG. 3 shows an embodiment of the casing which differs from the embodiment illustrated in FIG. 2 in that the powder filling is changed. In FIG. 3, the same elements as in FIG. 2 are denoted by the same reference numerals so that there is no need for these elements to be described again. In the embodiment shown in FIG. 3, powder A is again filled to a level $L_1$ above the plug 40 at the bottom end. This is followed by the introduction to a level $L_2$ of an intermediate layer M consisting of a mixture of the two powders A and B, the mixing ratio between the two powders A and B changing continuously so that the proportion of powder A above the level $L_2$ of this intermediate layer M gradually decreases from 100% to 0% whilst the proportion of powder B increases accordingly from 0% to 100%, so that a smooth, continuous transition in composition is obtained between powder A introduced into section $L_1$ and powder B introduced into the following section $L_3$. Above the powder B introduced to a level $L_3$, there is a second intermediate layer with a height $L_4$ in which the mixing ratio changes in the reverse order, i.e. the proportion of powder B above the height $L_4$ of this intermediate layer gradually decreases from 100% to 0% whilst the proportion of powder A increases accordingly from 0% to 100%. More powder A is then introduced above this intermediate layer. In the embodiment shown in FIG. 3, the heights $L_1$ and $L_5$ are substantially the same whilst the height $L_3$ is substantially twice the heights $L_1$ and $L_5$ because, after it has been extruded, the tube is divided in the region of the powder filling B to obtain two tubular composite elements.

Figure 3A:
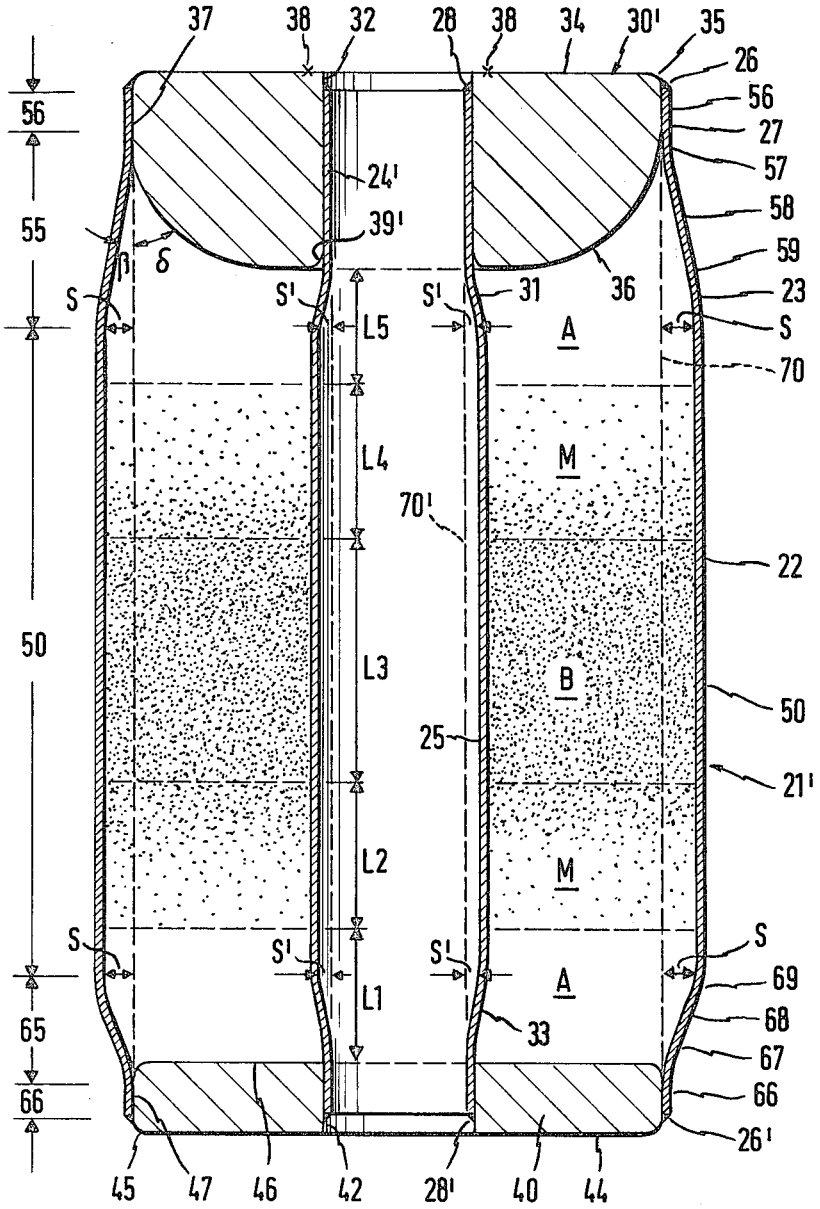

FIG. 3*a* shows an embodiment similar to that illustrated in FIG. 3, the powder filling also being the same as in FIG. 3. However, the casing 21' illustrated in FIG. 3*a* differs from the casing illustrated in FIG. 3 in that, in FIG. 3*a*, the inner jacket 24' is provided with a bulge 25. The increase in radius S' of the bulge 25 of the inner jacket 24' is smaller than the radial bulge S of the outer jacket 22 by the ratio between the radii of the inner and outer jackets. During the cold isostatic pressing operation, the bulge 25 shrinks to the line 70' so that the inner jacket 24' is completely restored to its cylindrical form after the cold isostatic pressing operation. The constricted upper and lower sections of the inner jacket 24' may be obtained by rolling or pressing the ends of the tube sections in the same way as in the outer jacket 22. In the embodiment illustrated in FIG. 3*a*, the transition from the arcuate cross-sectional profile 36 to the bore 32 of the front plug 30' at 39' is not bevelled as much as in the embodiment shown in FIG. 3. The bulge in the outer jacket and the inner jacket provide for even better centring and dimensional accuracy of the pressing and hence for better quality in the extrusion of the material.

Figure 4:
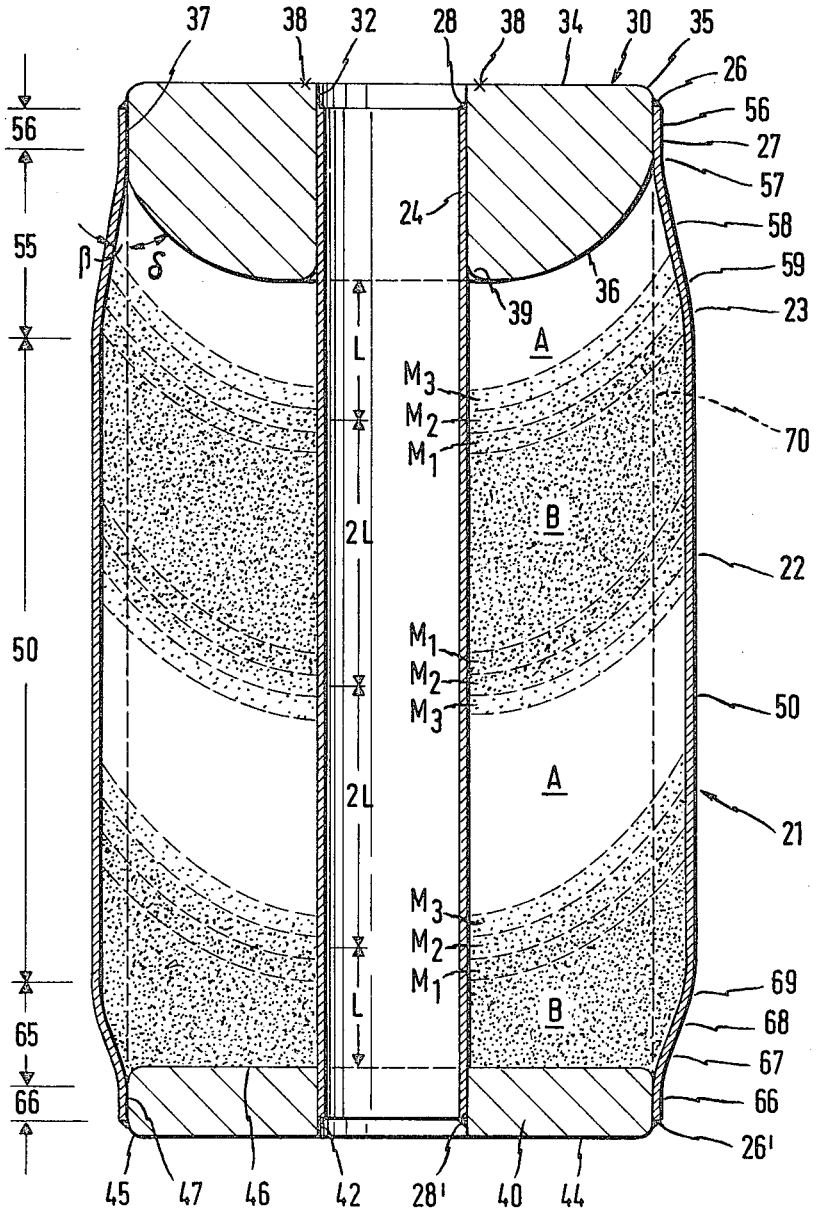

The casing 21 shown in FIG. 4 corresponds in its structure to the casing shown in FIG. 3 and the same elements are also denoted by the same reference numerals. However, the powder filling in the embodiment shown in FIG. 4 differs from that in the embodiment shown in FIG. 2. In particular, three intermediate layers are provided in FIG. 4 with a mixing ratio $M_1$ of 25% of powder A to 75% of powder B, a mixing ratio $M_2$ of 50% of powder A to 50% of powder B and a mixing ratio $M_3$ of 75% of powder A to 25% of powder B. In addition, the intermediate layers $M_1$, $M_2$ and $M_3$ in FIG. 4 have parabola-like cross-sections. This parabola-like cross-sectional form is obtained by rotating the casing 21 about its longitudinal axis while it is being filled with the powders or powder mixtures so that, under the effect of the cetrifugal forces acting on it susrface, the powder introduced assumes a parabola-like cross-sectional structure. By suitably selecting the amplitude of the vibration used for condensing the powder introduced and the speed of rotation of the casing 21 about its longitudinal axis, the parabola-like cross-sectional profile of the powder surface may be roughly adapted to the arcuate cross-sectional profile 36 of the front plug 30 and hence also to the arcuate cross-sectional profile of the metal dishes $C_1$, $C_2$ and $C_3$ described in reference to FIG. 1. After extrusion, three tubular composite elements can be produced from the casing shown in FIG. 4 by dividing the tube obtained in those regions which correspond to the two powder fillings introduced to a level $_2L$.

Figure 5:
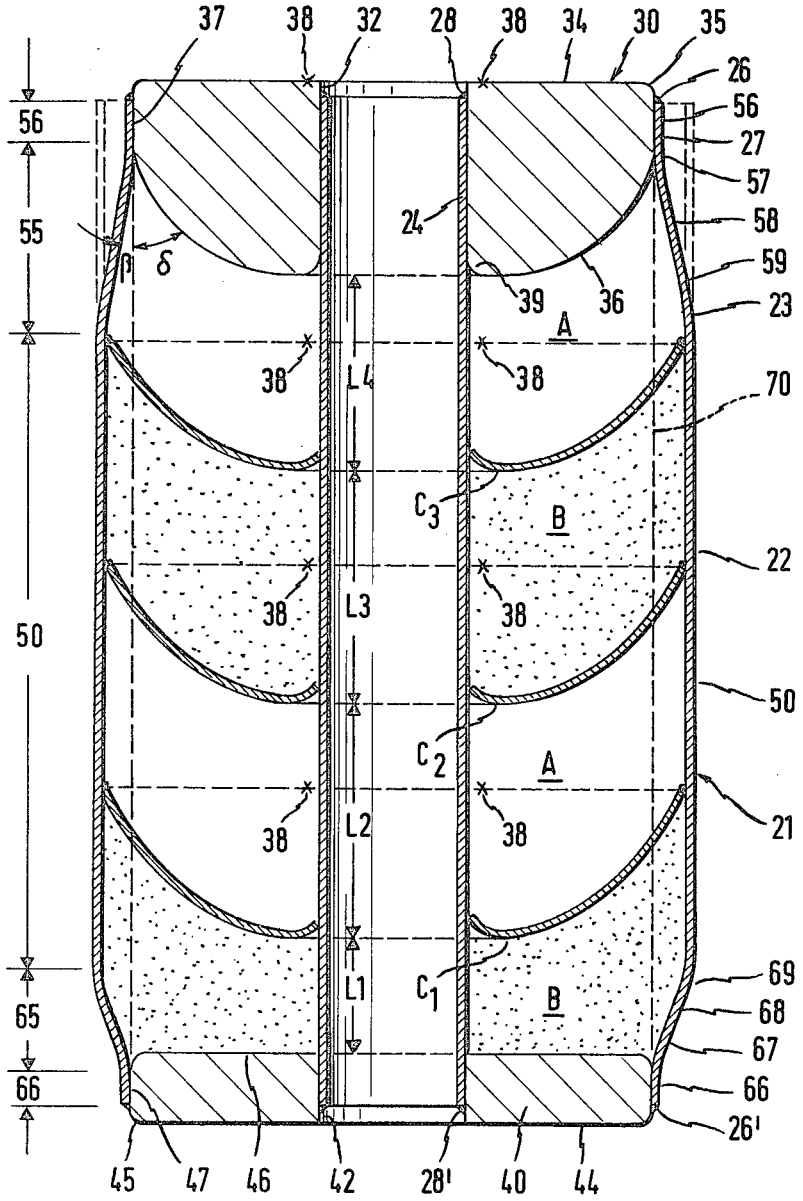

FIG. 5 shows an embodiment of the casing 21 similar to the embodiment shown in FIG. 2, the difference being that metallic intermediate layers $C_1$, $C_2$ and $C_3$ are arranged between the powder fillings A and B similar to the embodiment illustrated in FIG. 1. As in the embodiment shown in FIG. 1, these metallic intermediate layers $C_1$, $C_2$ and $C_3$ preferably consist of nickel and may have a thickness of from 0.1 to 0.5 mm for example. Annular dishes such as these, which have an arcuate cross-sectional profile, are preferably produced by deep drawing. To make these annular dishes $C_1$, $C_2$, $C_3$ easier to introduce into the casing 21 while it is being filled, it can be of advantage to constrict the casing at its upper end only after the annular dish $C_3$ has been introduced and fixed by spot welding to the outer jacket 22 and the inner jacket 24. Through the constricton of the upper end of the outer jacket 22, this end is converted from the form shown in chain lines in FIG. 5 to the form shown in solid lines in FIG. 5. According to the invention, constriction may be carried out by means of a pressing tool. This pressing tool has an annular gap which exactly corresponds in its form to the required form of the transitional section 25 and the cylindrical section 56 of the outer jacket 22 and of which the gap width substantially coincides with the material thickness of the outer jacket 22. This pressing tool is pushed axially over the end of the outer jacket, thus providing the end of the outer jacket with the required change in shape. After the upper end of the outer jacket has been constricted, powder A is introduced above the annular dish $C_3$ to a level which is somewhat higher than the level $L_4$ so that, after the plug 30 has been pressed in, the powder is firmly applied to the lower outer surface of the plug and the casing is completely filled with powder. Thereafter the casing is tightly welded by means of the encircling weld seams 26 and 28. The tightly welded casing, in which the powder filling has a density of more than 60% and more particularly of the order of 66% of the theoretical density through compaction by vibration, may then be subjected to cold isostatic pressing as a result of which the density of the powder filling is increased to more than 80% and, more particularly, to around 88% of the theoretical density. The pressing thus obtained is then heated and hot extruded to form the tube. By dividing the tube substantial at the middle of its regions corresponding to the powder fillings $L_2$ and $L_3$, three tubular composite elements can be obtained from the extruded tube.

Since the annular dishes $C_1$, $C_2$, $C_3$ have an arcuate cross-sectional profile similar to the arcuate cross-sectional profile 36 of the front plug and since the centre points of this arcuate cross-sectional profile of the annular dishes $C_1$, $C_2$ and $C_3$ lie on a circle which is indicated in FIG. 5 by the crosses 38' and which lies substantially in the plane passing through the outer edge of the dishes $C_1$, $C_2$ and $C_3$ and extends concentrically around the inner jacket 24 at an interval corresponding substantially to half the width of the annular gap of the extrusion tool, the boundaries between the sections consisting of different powders in the extruded tube are reliably able to form planes extending substantially perpendicularly of the tube axis. The arrangement and configuration of the intermediate layers and annular dishes enables a number of tubular composite elements to be produced by means of a single casing. It has been found in practice that 5 and more, particularly 8 and more, tubular composite elements may readily be produced in this way by means of a single casing because, in the tube extruded from the casing, the boundaries between the individual powder fillings are sufficiently clearly defined and extend substantially perpendicularly of the tube axis. This makes the process according to the invention extremely economical, particularly when 8, 10 or more tubular composite elements are to be produced in accordance with the invention from a single casing and by a single extrusion process.

According to the invention, however, it is possible simultaneously to produce different composite elements by the same process using a single casing. For example, the powder filling introduced between the dishes $C_2$ and $C_3$ may consist—instead of powder B—of a powder C which is prepared from a third material different from powders A and B. In this case, a casing divided up by means of three dishes gives a tubular composite element of which the tube ends consist of materials A and B and two tubular composite elements of which the tube ends consist of materials A and C. In another variant of the invention, the powder A between the dish $C_3$ and the front plug 30 in the embodiment shown in FIG. 5 may be replaced by the powder B. If then, as previously assumed, powder of a third quality C is introduced between the dishes $C_2$ and $C_3$, three different tubular composite elements are obtained if powder B is introduced between the base 40 and dish $C_1$ and powder A between dishes $C_1$ and $C_2$, the tube ends in the case of the first composite element consisting of materials B and A, the tube ends in the case of the second composite element consisting of materials A and C and the tube ends in the case of the third composite element consisting of materials C and B. When the powder filling of a casing is divided by more than three intermediate layers, i.e. for example by 4, 5, 6, 8 or more intermediate layers, it is similarly possible to obtain a larger variation of different composite elements, in other words different powders may be introduced into the different sections of the powder filling divided by the intermediate layers providing this is of advantage for production reasons.

To sum up, therefore, it is pointed out that, using the process according to the invention, a relatively large number, particularly 5, 8, 10 or more composite elements, of which both tube ends consist of two different materials, can be produced very economically be means of a single casing, the materials in question being selectable as required by introducing different powders into the sections of the casing divided up by the intermediate layers.

According to the invention, it is possible with advantage to produce from a single pressing 3 or more, preferably 5 or more, particularly at least 8, tubular composite elements, in all of which one tube end consists of a powder A and the other tube end of a powder B. Alternatively, by introducing 3 or more different powders A, B, C . . . into the corresponding sections of the casing, it is possible to produce from a single pressing different composite elements in which the two tube ends of two different powders A, B and/or B, C and/or A, C; . . . of the above-mentioned 3 or more powders A, B, C . . . are combined in such a way that different composite elements are formed.

According to the invention, the axial length 2L in FIG. 1 and the axial lengths $L_2$ and $L_3$ in FIG. 5 of the individual powder fillings to be divided is advantageously substantially equal to or less than, but preferably substantially equal to or less than $\frac{1}{2}$ and, more particularly, substantially equal to or less than $\frac{1}{3}$ of the internal diameter of the casing interior arising out of the difference between the radius of the outer jacket and the radius of the inner jacket in order to be able to produce as large a number of composite elements as possible from a single pressing. The axial length L in FIG. 1 and the axial lengths $L_1$ and $L_4$ in FIG. 5 of the powder fillings adjacent the front plug 4; 30 and the bottom plug 5; 40 is preferably half the axial lengths 2L and $L_2$ and $L_3$ of the powder fillings to be divided.

I claim:

1. A process for the simultaneous production of a plurality of tubular composite elements of metal having opposite ends of different materials, comprising the steps of:

(A) axially alternately and separately introducing at least two powders, each consisting of one of the different materials into a metallic hollow cylindrical casing in at least three sections of predetermined axial length;

(B) condensing sections of the powders by vibration, including ultrasound, to around 60–70% of the theoretical density;

(C) closing the casing;

(D) cold isostatically pressing the closed casing under a pressure of at least about 3,000 bars to at least 80% of the theoretical density for a pressing;

(E) heating and subsequently hot-extruding the pressing to form a tube; and (F) dividing the tube into two or more composite elements having a different material at opposite ends thereof.

2. A process as claimed in claim 1, wherein said powders are produced by atomization of melts and consist predominantly of spherical particles.

3. A process as claimed in claim 2, wherein step A further comprises the step of introducing a metallic intermediate layer at the boundary between each of the sections of the powders.

4. A process as claimed in claim 3, characterized in that the metallic intermediate layers consist of a material which exhibits or prevents the diffusion of impurities and/or alloying elements, particularly carbon.

5. A process as claimed in claim 4, wherein said intermediate layers are formed of nickel.

6. A process as claimed in claim 3, wherein said intermediate layers comprise mixtures of said powders.

7. A process according to claim 3 or 4 or 5 or 6, wherein said intermediate layers are dish-shaped, and have an arcuate cross-sectional profile.

8. A process as claimed in claim 3 or 4 or 5, characterized in that sheet metal rings are used as the intermediate layers.

9. A process according to claim 8, wherein said intermediate layers are dish-shaped, and have an arcuate cross-sectional profile.

10. A process as claimed in claim 9, characterized in that a parabola-like cross-sectional profile is imparted to the surface of the powder filling by rotation of the casing about its longitudinal axis at least before the introduction of an intermediate layer.

11. A process according to claim 10, wherein said rotation is also imparted during introduction of the boundary layer.

12. A process as claimed in claim 9, characterized in that a parabola-like cross-sectional profile is imparted to the surface of the powder filling by rotation of the casing about its longitudinal axis during the introduction of an intermediate layer.

13. A process as claimed in claim 12, characterized in that the conical or funnel-shaped metallic intermediate layers are pressed into the powder filling by means of a tool until the powder filling is firmly applied substantially everywhere to a convex lower outer surface of the metallic intermediate layer.

14. A process as claimed in claim 13, characterized in that, to generate a relative rotational movement between the intermediate layer and the powder filling, when the intermediate layer is pressed into the powder filling, the intermediate layer is rotated about the longitudinal axis of the casing.

15. A process as claimed in claim 8, characterized in that the intermediate layers arranged between the sections are conical or funnel-shaped and have a substantially arcuate cross-sectional profile forming a circle which lies substantially in a plane passing through an outer edge of the intermediate layer and which extends concentrically around an inner jacket of the casing.

16. A process as claimed in claim 8, characterized in that the metallic intermediate layers consist of at least a single-layer of narrow-mesh wire netting.

17. A process as claimed in claim 16, characterized in that the intermediate layers arranged between the sections are conical or funnel-shaped and have a substantially arcuate cross-sectional profile forming a circle which lies substantially in a plane passing through an outer edge of the intermediate layer and which extends concentrically around an inner jacket of the casing.

18. A process as claimed in claim 17, characterized in that the conical or funnel-shaped metallic intermediate layers are pressed into the powder filling by means of a tool until the powder filling is firmly applied substantially everywhere to a convex lower outer surface of the metallic intermediate layer.

19. A process as claimed in claim 18, characterized in that, to generate a relative rotational movement between the intermediate layer and the powder filling, when the intermediate layer is pressed into the powder filling, the intermediate layer is rotated about the longitudinal axis of the casing.

20. A process according to claim 19, wherein said casing is rotated during said pressing of the intermediate layer.

21. A process according to claim 16, wherein the intermediate layers are fixed by spot welding.

22. A process according to claim 3, wherein the intermediate layers are formed of layers of filaments which are compressed into a fleece.

23. A process as claimed in claim 3, characterized in that the metallic intermediate layers consist of at least a single-layer of narrow-mesh wire netting.

24. A process as claimed in claim 6, characterized in that, during introduction of the intermediate layers, the mixing ratio between the powders is continuously altered in such a way that the proportion of a first powder, of which a previously filled section exclusively consists, gradually decreases from 100% to 0% over the thickness of the intermediate layer and the proportion of a second powder increases from 0% to 100% so that there is a smooth continuous transition in the composition of material between the previously filled section consisting of the first powder and the section consisting of the second powder to be filled after the intermediate layer.

25. A process as claimed in claim 3 or 4 or 6 or 24, characterized in that the intermediate layers arranged between the sections are conical or funnel-shaped and have a substantially arcuate cross-sectional profile, the centre points of this arcuate cross-sectional profile forming a circle which lies substantially in a plane passing through an outer edge of the intermediate layer and which extends concentrically around an inner jacket of the casing.

26. A process as claimed in claim 25, characterized in that the metallic intermediate layers are in the form of annular dishes which have a substantially arcuate cross-sectional profile.

27. A process as claimed in claim 1 or 3 or 6, characterized in that a parabola-like cross-sectional profile is imparted to the surface of the powder filling by rotation of the casing about its longitudinal axis at least before the introduction of an intermediate layer.

28. A process according to claim 27, wherein said rotation is also imparted during introduction of the boundary layer.

29. A process as claimed in claim 1 or 3 or 6, characterized in that a parabola-like cross-sectional profile is imparted to the surface of the powder filling by rotation of the casing about its longitudinal axis during the introduction of an intermediate layer.

30. A process as claimed in claim 3 or 4 or 5 or 6, characterized in that step C is performed with an annular plug which is made of at least one part of solid material and has an arcuate profile at a side which is inserted into the casing, the plug being tightly joined, by welding, to outer and inner jackets of the casing.

31. A process as claimed in claim 1 or 3, characterized in the further step of introducing intermediate layers of a material capable of preventing a metallic bond for forming predetermined breakage zones in those sections to be divided in step F.

32. A process as claimed in claim 31, wherein said breakage zones forming layers are funnel-like or conical in shape with an arcuate cross-sectional profile, and wherein a plug provided at the front end of the casing also is provided on a surface directed towards the powder filling with a layer of any material capable of preventing a metallic bond.

33. A process as claimed in claim 3 or 4 or 5 or 6, characterized in that a casing is used in which at least the outer jacket is provided with an outwardly directed bulge which is designed to take up the shrinkage which occurs during said isostatic pressing and which is gauged in such a way that it is substantially eliminated again by the shrinkage which occurs during the isostatic pressing operation.

34. A process as claimed in claim 33, characterized in that the bulge is produced at at least one end of the casing by constricting this end of the casing by means of a pressing tool which has an annular gap of which the shape substantially corresponds to the required shape of a transitional zone and a smaller-diameter cylindrical section of the jacket and of which the gap width substantially corresponds to the material thickness of the end of the jacket to be constricted, the pressing tool being advanced axially relative to that end of the jacket to be constricted.

35. A process as claimed in claim 34, characterized in that at least the constriction of that end of the outer jacket, through whose opening the powder fillings and the metallic intermediate layers are introduced, is only effected by means of the axially advanced pressing tool after the powder filling, including the intermediate layers, has been substantially introduced into the bulge section of the outer jacket which retains its cylindrical shape.

36. A process as claimed in claim 1 or 3, characterized in that a casing is used of which at least the outer jacket has substantially the same strength properties in the axial direction along its circumference.

37. A process as claimed in claim 36, characterized in that step C is performed with a front plug having a flat end face which, along its outer circumference, changes into a bevelled edge, and in that to obtain effective lubrication during the hot-extrusion of step E, glass is used for lubrication in the form of a glass disc at the end of the pressing in a container or receptacle of the extrusion press with a flat front end surface, said glass being delivered in the peripheral direction in substantially uniform distribution between the tool and the extruded object throughout the entire extrusion process as a result of the bevelled front edge of the front plug of the casing in conjunction with a very accurate adaptation of the substantially cylindrical external diameter of the pressing to a substantially cylindrical internal diameter of the container or receptacle of the extrusion press.

38. A tubular composite element produced by the process of claims 1 or 3 or 4 or 5.

39. A pressing for simultaneously producing a plurality of tubular composite elements of metal having opposite ends of different materials by hot-extrusion, comprising:

(A) a metallic hollow cylindrical casing having a closure plug at fron and rear ends thereof; and (B) at least three axially alternate and separate sections of powders located within said casing, each consisting of one of the different materials and being of a predetermined axial length, said powders having been condensed within the casing to 60–70% of the theoretical density by vibration, including ultrasound, and subsequently increased to 80% of theoretical density by cold isostatic pressing.

40. A pressing as claimed in claim 39, characterized in that metallic intermediate layers are located at the boundaries between the sections of the casing consisting of powders of the different materials.

41. A pressing as claimed in claim 40, wherein the intermediate layers are layers of metal filaments which have been compressed into a fleece.

42. A pressing as claimed in claim 40, characterized in that the plug at the front end of the casing comprises a conical, hemispherical or funnel-shaped plug which is made in at least one piece of solid material and the plug at the rear end of the casing comprises a plate-like plug which is made in one piece of solid material, the front and rear plugs being tightly joined by welding to the outer and inner jackets of the casing.

43. A pressing as claimed in claim 40, characterized in that the metallic intermediate layers consist of a material which prevents or inhibits the diffusion of impurities or alloying elements, particularly carbon.

44. A pressing as claimed in claim 43, wherein said metallic intermediate layers are formed of nickel.

45. A pressing as claimed in claim 44, wherein the intermediate layers are fixed to said casing by spot welding.

46. A pressing as claimed in claim 44, characterized in that the metallic intermediate layers are in the form of annular dishes having a substantially arcuate cross-sectional profile.

47. A pressing as claimed in claim 40, characterized in that the metallic intermediate layers consist of at least a single-layer of narrow-mesh wire netting.

48. A pressing as claimed in claim 40, characterized in that the metallic intermediate layers are in the form of annular dishes having a substantially arcuate cross-sectional profile.

49. A pressing as claimed in claim 39, characterized in that boundaries between the sections consisting of one of the powders are conical or funnel-shaped with a substantially arcuate cross-sectional profile, the centre points of this arcuate cross-sectional profile forming a circle which extends substantially concentrically around an inner jacket of the casing.

50. A pressing as claimed in claim 49, characterized in that the intermediate layers consist of a mixture of the powders made of different materials.

51. A pressing as claimed in claim 50, characterized in that, in the intermediate layers, the mixing ratio between the powders changes continuously in the axial direction in such a way that the proportion of the first powder, of which the preceding section exclusively consists, gradually decreases from 100% to 0% over the thickness of the intermediate layer and the porportion of the second powder increases from 0% to 100% in such a way that a smooth continuous transition in the composition of material is obtained between the previously filled section consisting of the first powder preceding the intermediate layer and the section consisting of the second powder which follows the intermediate layer.

52. A pressing as claimed in claim 39 or 49, characterized in that the plug at the front end of the casing comprises a conical, hemispherical or funnel-shaped plug which is made in at least one piece of solid material and the plug at the rear end of the casing comprises a plate-like plug which is made in one piece of solid material, the front and rear plugs being tightly joined by welding to outer and inner jackets of the casing.

53. A pressing, particularly as claimed in claim 52, characterized in that intermediate layers of any material capable of preventing a metallic bond are located in at least one of the sections consisting of only one of the powders in order to form breakage zones, by which a tube, extruded from said pressing, is divisible into the individual composite elements in the region of these breakage zones.

54. A pressing as claimed in claim 53, wherein said breakage zone forming intermediate layers having a funnel-like or conical form with an arcuate cross-sectional profile and the plug provided at the front end of the casing is provided on its surface directed towards the powder filling with a layer of any material capable of preventing a metallic bond.

55. A pressing as claimed in claim 39, characterized in that said casing comprises at least an outer jacket provided with an outwardly directed bulge which has been eliminated by shrinkage which occurs due to said isostatic pressing.

* * * * *